US005885379A

United States Patent [19]

Snyder

[11] Patent Number: 5,885,379

[45] Date of Patent: Mar. 23, 1999

[54] TEMPERED POWDERED METALLURGICAL CONSTRUCT AND METHOD

[75] Inventor: Lyle K. Snyder, Mercer Island, Wash.

[73] Assignee: The Landover Company, Carson City, Nev.

[21] Appl. No.: 828,304

[22] Filed: Mar. 28, 1997

[51] Int. Cl.[6] ..... C21D 1/76

[52] U.S. Cl. ..... 148/514; 148/712; 419/29

[58] Field of Search ..... 148/508, 514, 148/712; 419/29, 57

[56] References Cited

U.S. PATENT DOCUMENTS

| | | | |
|---|---|---|---|
| 2,239,800 | 4/1941 | Vogt et al. . | |
| 2,637,671 | 5/1953 | Pavitt . | |
| 2,893,102 | 7/1959 | Maxwell et al. . | |
| 2,928,733 | 3/1960 | Wagner . | |
| 3,725,142 | 4/1973 | Huseby . | |
| 3,796,563 | 3/1974 | Wieland, Jr. et al. . | |
| 4,063,940 | 12/1977 | Dain et al. . | |
| 4,585,619 | 4/1986 | Westin . | |
| 4,612,162 | 9/1986 | Morgan et al. . | |
| 4,684,405 | 8/1987 | Kolaska et al. | 419/29 |
| 4,721,599 | 1/1988 | Nakamura . | |
| 4,734,967 | 4/1988 | Byrda et al. . | |
| 4,923,671 | 5/1990 | Aslund . | |
| 4,956,336 | 9/1990 | Salama et al. . | |
| 5,387,272 | 2/1995 | Kamitsuma et al. . | |
| 5,417,917 | 5/1995 | Takahar et al. . | |
| 5,478,522 | 12/1995 | Wang . | |

FOREIGN PATENT DOCUMENTS

| | | | |
|---|---|---|---|
| 2-228421 | 9/1990 | Japan | 148/712 |
| 2108153 | 5/1983 | United Kingdom | 148/712 |

OTHER PUBLICATIONS

*ASM Handbook,* vol. 4, Heat Treating, pp. 552–567, ASM, 1991.

*Primary Examiner*—George Wyszomierski
*Attorney, Agent, or Firm*—Christensen O'Connor Johnson Kindness PLLC

[57] ABSTRACT

A method of tempering powdered metallurgical constructs, that includes first deoxygenating and dehydrating powdered metal compacts before tempering. During the process, the sintered compacts are first preheated to a temperature that desorbs water vapor and oxygen from interstitial spaces of the compact, while not accelerating the rate of oxidation of any metal component. Once deoxygenation and dehydration has been achieved, the compact is heated to a tempering temperature in a substantially oxygen and water vapor-free environment and is maintained at that temperature until tempering is complete. Substantially oxygen and water-vapor free environmental conditions are maintained while the tempered compacts are cooled, to avoid post-oxidation. The resultant tempered powdered metal devices have increased strength, ductility and better machinability than conventionally tempered constructs.

10 Claims, No Drawings

TEMPERED POWDERED METALLURGICAL CONSTRUCT AND METHOD

FIELD OF THE INVENTION

The invention relates to the heat-treatment of constructs ("compacts") of powdered metal to produce tempered products of improved strength, machinability and ductility.

BACKGROUND OF THE INVENTION

Powdered metal technology provides the opportunity to produce articles from mixtures of metals that could not otherwise be prepared by the traditional method of mixing molten metals together. To produce the powders, alloys or pure metals are first melted and the molten stream is atomized by water jets to produce irregularly-shaped metallic particles. Because of their irregular shape, particles of powdered metal have good compactability which facilitates their subsequent formation into finished articles.

Powdered metal is first compacted under high pressure into a shape that approximates the final product. The pressure causes the powdered particles to lock together mechanically, but the compacted product ("compact") retains significant porosity. To reduce porosity, the compact is further treated by heating in a process known as sintering, with or without the application of pressure. During sintering, a compact is subjected to sufficient heat that at least some part of the components of the powder enter into a liquid phase which fills the pores within the compact.

It has been recognized that when the powder was made by water atomization of a melt, it may have an undesirably high oxygen content. The presence of oxygen in combined form in the compact, or in the final product, has a deleterious effect resulting, for example, in inferior strength. U.S. Pat. No. 4,063,940 addresses the sintering of powdered metal compacts in a deoxygenated atmosphere to cause densification of the compact to at least 98% relative density. By deoxidizing the powder, higher sintering temperatures can be used, preferably in the range 1,050°–1,200° C., but below the solidus temperature of the alloy.

While the '940 patent addresses the issues of increased densification of powdered metal compacts, and more efficient deoxidization at higher temperatures, the patent does not address critical issues of ductility, strength and machinability of powdered metal products. Thus, for example, powdered metal products intended for precision applications must subsequently be machined to close tolerances for intended use. Because of the hardness of the sintered powdered metal products, machinability in terms of wear of the machine tool, becomes a significant factor. Moreover, for certain applications the product should retain a level of ductility that allows ordinary manipulation with minimal risk of breakage. Thus, for example, valve seat inserts for automotive applications that are fabricated through powdered metallurgical techniques must be precision machined and thereafter manipulated into position in an engine. From a production stand point, a reduction in machine tool wear would reduce the downtime associated with changing the cutting tool and allows better utilization of expensive capital equipment. Moreover, improved ductility would reduce the number of valve seats that must be rejected due to failures that arise from a lack of ductility.

SUMMARY OF THE INVENTION

The invention provides a method of tempering powdered metal compacts (after they have already undergone a first sintering process) to produce products of improved strength, machinability and ductility.

In accordance with the invention, a powdered metal compact is placed in a furnace in which the environment is controlled so that it is substantially oxygen-free. Moreover, the environment is also controlled so that it is substantially water-free. Thus, as the compact is heated up to a temperature of about 270°–400° F., and as water and oxygen are driven off from interstitial spaces within the compact, the environment is continually monitored and controlled to maintain substantially oxygen and water-free conditions. Importantly, while the temperature is increased to drive off water and oxygen, the temperature is not increased to a point at which rapid oxidation of any metal component would commence. When substantially all of the water and oxygen has been driven out of the compact, a condition which can be detected when the temperature is increased and the dew point and oxygen content of the environment does not increase, the temperature of the furnace is increased to the range 700°–1,250° F., to temper the compact. The compact is maintained at this temperature for a time sufficient to achieve the hardness desired. Thereafter, the tempered product is allowed to cool to at least about 700° F. (consistent with avoiding tempered martensitic embrittlement or blue temper embrittlement) in the substantially oxygen-free and water-free environment. Subsequent further cooling may be carried out under ambient environmental conditions.

DETAILED DESCRIPTION OF THE PREFERRED EMBODIMENT

The heat treatment process of the invention is preferably applied to powdered metal compacts that have already undergone sintering. Conventionally, powdered metal compacts are produced under high pressure (of the order of 120,000 pounds per square inch) in molds, and then sintered to allow melting of at least some of the metallic powder. Thereafter, the compact is cooled to room temperature.

In accordance with the tempering heat treatment protocol of the invention, a (preferably) sintered compact is placed in an environment that can be modified to remove substantially all water vapor and oxygen. Thus, during subsequent steps of heating the compact, even though oxygen and water vapor may be driven off from interstices within the compact, these gaseous components are removed from the environment to maintain substantially oxygen-free and water-free conditions.

As a practical matter, a substantially water-free and oxygen-free environment can be created inside a furnace by supplying a continuous stream of an inert purge gas, such as nitrogen, to drive out any oxygen and water vapor from the furnace, and/or applying a vacuum. Conditions within the furnace may be sampled continuously or periodically, and analyzed in oxygen and water vapor detectors. In order to maintain these conditions in an ordinary furnace that is not hermetically sealed, purge gas can be conducted into the furnace at such a rate that a positive pressure, higher than surrounding atmospheric pressure, is maintained in the furnace. Thus, false air cannot leak into the furnace and any excess purge gas may continuously leak from any unsealed openings in the furnace.

In accordance with the invention, powdered metal compacts are placed in the furnace. The furnace is closed and a flow of nitrogen, or another inert gas, into the furnace is commenced to purge the environment of oxygen and water vapor. These two compositions are detected and read, either continuously or at intermittent intervals. The temperature of the furnace is then gradually increased, without exceeding any temperature at which a metal component of the powdered metal compact is subject to rapid oxidation. Thus, for instance, in the case of a metal compact that includes iron, as the metal with the lowest oxidation temperature, the temperature should not typically exceed about 350° F. and preferably not exceed about 270° F. during this dehydration and deoxygenation phase. Clearly, the higher the temperature, the more rapid the dehydration and deoxygenation but, higher temperature also increases the rate of oxidation of the compact. Thus, temperatures should preferably not exceed about 350° F.

During the time that the temperature in the furnace is increasing, oxygen and water absorbed within the powdered metal compact are desorbed into the environment, which may cause an increase in oxygen and water vapor concentrations. The inert gas rate should be set sufficiently high to sweep these desorbed components from the environment, and maintain a substantially oxygen-free and substantially water-free environment.

"Substantially oxygen-free" in the specification and claims, means an environment in which the oxygen content is less than 50 ppm, preferably in the range from about 5 to about 50 ppm, and most preferably in the range from about 5 to about 30 ppm.

"Substantially water-free" as used in the specification and claims, means that the environment has a dew point of less than about −60° F., and preferably less than about −100° F.

The preheating dehydration and deoxygenation step is continued until the compact is dehydrated and deoxygenated. This condition is readily tested by increasing the temperature, and observing whether the oxygen or water vapor content of the environment increases. If no increase is detected, then no further water or oxygen is being driven off from the compact, so that it is essentially deoxygenated and water-free. When this point has been reached, tempering may commence.

In accordance with the invention, the temperature of the furnace is increased up to the range 700°–1,250° F., to carry out the tempering of the powdered metal compact. The tempering step is also carried out under substantially oxygen-free and water-free conditions. Tempering is continued for a sufficient time to produce the desired microhardness. The microhardness obtained can be estimated using conventional time versus temperature curves developed for wrought materials that have the same metal composition as the compact undergoing tempering. Typically, for a tool steel powdered metal compact, such as may be used for a metal valve seat, the tempering process is continued for at least about one hour or about one hour and forty-five minutes or longer. Clearly, the time will depend upon the desired hardness, the temperature, and the relative mass or bulkiness of the compact undergoing treatment. Importantly, in accordance with the invention, the tempering environment is maintained substantially oxygen and water-free.

Once tempering is complete, the energy supplied to the furnace is turned off, and the furnace and its contents are preferably allowed to cool down naturally. The environment within the furnace is still preferably maintained substantially free of oxygen and water vapor, until the temperature drops to at least about 700° F., preferably at least about 500° F. The tempered products may then be removed from the furnace and allowed to cool in air to room temperature.

It has been found that products treated in accordance with the method of the invention have improved strength, ductility and machinability. It is theorized, without being bound, that the environmental conditions maintained within the furnace (i.e., substantially water and oxygen-free conditions) minimizes or eliminates the formation of oxides within the powdered metal compacts. As a result, strength, ductility and machinability properties are dramatically improved.

The examples that follow illustrate aspects of the invention and should not be construed as limiting the invention in any way. The scope of the invention is set forth in the foregoing description and the claims that follow.

EXAMPLES

Comparative testing was performed on samples of two types of parts, Part No. 1 and Part No. 2, each made from the same powdered metal and additive mixture. The mixture included: 45 pounds of MP52 (powdered sponge iron from Domfer Metal Powders Limited of Canada); 45 pounds of M2 tool steel powder (Powdrex Limited of Tonbridge, Kent, England); 0.45 pound of powdered carbon; 0.45 pound of molybdenum disulfide ($MoS_2$) and 0.45 pound of a binder GLYCOLUBE PM100 (Lonza, Inc. of Switzerland) or ACRAWAX (Lonza, Inc. of Switzerland).

Samples of the mixture were placed in molds, and were compacted into a series of compacts, some corresponding to Part No. 1, and other to Part No. 2. All of the compacts were then sintered under the following conditions. The compacts were placed on a moving belt of a continuous conveyor furnace, where they were first preheated to 1,200° F. over a period of 30 minutes. Then, the compacts entered into the hotter region of the furnace where they were subjected to 2,100° F. for about 50 minutes. The sintered compacts then traveled through a water-jacketed cooling section where they were cooled down to 100° F. over a period of about 30 minutes. The belt speed of the furnace was approximately 1.5 inches per minute.

The cooled sintered compacts were divided into two sets of samples; a first set of samples was tempered under conventional conditions; and a second set of samples was tempered in accordance with the method of the invention.

The conventionally-tempered samples (AC1-EC1; AC2-EC2) were heated to 1,145° F., and maintained at that temperature for about 1 hour and 45 minutes. The samples were then cooled to 700° F. and then removed from the furnace to cool in ambient air.

The samples that were treated in accordance with the invention, were placed in a furnace that was flooded with dry nitrogen, to purge the interior of the furnace of oxygen and water vapor. The furnace was heated to 350° F., and was maintained at this temperature until oxygen and water vapor concentrations within the furnace remained constant at 10 ppm and a dewpoint of −100° F., respectively. When the oxygen and water concentrations no longer increased as temperature was increased (i.e., the compacts were deoxygenated and dehydrated), the furnace temperature was increased to 1,145° F., while maintaining the reduced oxygen and water vapor concentrations. After tempering at this temperature for one hour and 45 minutes, the compacts were allowed to cool to 700° F. in the furnace. At this point, the tempered compacts were removed from the furnace and allowed to cool in air.

Table I illustrates the characteristics of eight samples the two parts "as sintered." The "break test" was performed by placing each of the samples of the ring-shaped parts between two parallel steel plates and applying force, measured with a Rimac spring tester, until the part broke. The "apparent hardness" was measured using a conventional Wilson Rockwell tester. A machinability test was not carried out for the "as sintered" parts, but the tempered parts were tested using uncoated C2 grade carbide tools in a lathe without coolant, and the number of samples that could be machined with the tool was measured.

As can be seen from a comparison of Tables I, II and III, the strength of conventionally tempered samples is significantly less than that of the sintered samples. However, the strength of the samples tempered in accordance with the invention (AM1-DM1; AM2-DM2) compares favorably with, and even exceeds, the strength of the sintered samples, measured by the break test. Moreover, the apparent hardness of the conventionally tempered samples is slightly lower than that of the as sintered samples. However, the hardness of the samples tempered in accordance with the invention is significantly lower than that of the as sintered samples. Accordingly, the machinability of the samples tempered in accordance with the invention is significantly better than that for conventionally tempered samples.

TABLE I

| Characteristics of "As Sintered" Parts | | |
|---|---|---|
| Sample | Break Test (pounds) | Apparent Hardness (HRC) |
| Part No. 1 | | |
| A1 | 570 | 36 |
| B1 | 675 | 36 |
| C1 | 570 | 35 |
| D1 | 675 | 36 |
| Part No. 2 | | |
| A2 | 425 | 34 |
| B2 | 500 | 32 |
| C2 | 500 | 35 |
| D2 | 450 | 33 |

TABLE II

| Characteristics of Conventionally Tempered Parts | | | |
|---|---|---|---|
| Sample | Break Test (pounds) | Apparent Hardness (HRC) | Machinability |
| Part No. 1 | | | |
| AC1 | 425 | 31 | |
| BC1 | 375 | 33 | |
| CC1 | 470 | 32 | 25 |
| DC1 | 350 | 34 | |
| EC1 | 450 | 31 | |
| Part No. 2 | | | |
| AC2 | 250 | 31 | |
| BC2 | 250 | 30 | |
| CC2 | 240 | 31 | 22 |
| DC2 | — | — | — |
| EC2 | — | — | — |

TABLE III

| Characteristics of Parts Tempered in Accordance with the Invention | | | |
|---|---|---|---|
| Sample | Break Test (pounds) | Apparent Hardness (HRC) | Machinability |
| Part No. 1 | | | |
| AM1 | 625 | 26 | |
| BM1 | 675 | 25 | |
| CM1 | 670 | 26 | 52 |
| DM1 | 650 | 24 | |
| Part No. 2 | | | |
| AM2 | 425 | 24 | |
| BM2 | 600 | 27 | |
| CM2 | 450 | 23 | 47 |
| DM2 | 575 | 26 | |

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of heat-treating a sintered powdered metal compact, the method comprising:

(a) dehydrating and deoxygenating the sintered compact while subjecting the compact to heat in an environment substantially oxygen-free and substantially water vapor-free;

(b) heating the dehydrated and deoxygenated compact to a tempering temperature while maintaining substantially oxygen-free and substantially water vapor-free environmental conditions;

(c) tempering the compact while maintaining substantially water vapor-free and substantially oxygen-free environmental conditions; and (d) cooling the compact to produce a tempered powdered metal compact.

2. The method of claim 1, wherein step (a) comprises dehydrating in an environment with a dew point in the range from about −60° to about −100° F.

3. The method of claim 1, wherein step (a) comprises deoxygenating in an environment wherein the oxygen concentration is from about 5 to 30 ppm.

4. The method of claim 1, wherein the step (b) of heating comprises heating to a temperature in the range about 700° F. to about 1,250° F.

5. The method of claim 1, wherein the step (c) of tempering comprises tempering for at least about one hour.

6. The method of claim 1, wherein the step (d) of cooling comprises cooling to at least about 700° F. in a substantially oxygen-free and water vapor-free environment.

7. A method of treating a sintered powdered metal compact, the method comprising:

(a) placing the sintered compact in a furnace;

(b) modifying an environment in the furnace to produce and maintain an environment substantially free of oxygen and substantially free of water vapor;

(c) preheating the compact to a temperature of at least about 270° F. to drive off water and oxygen from the compact, while maintaining the substantially oxygen-free and water vapor-free environment in the furnace;

(d) heating the compact to a tempering temperature in the range from about 700° F. to about 1,250° F., while maintaining substantially oxygen-free and substantially water vapor-free conditions in the environment; and (e) cooling the compact to a temperature of about 700° F., while maintaining a substantially oxygen-free and substantially water vapor-free environment.

8. The method of claim 7, comprising maintaining the environment in the furnace at a greater pressure than ambient atmospheric pressure.

9. The method of claim 7, wherein the substantially water vapor-free environment has a dew point in the range about −60° F. to about −100° F.

10. The method of claim 7, wherein the substantially oxygen-free environment comprises an oxygen concentration in the range from about 5 to about 30 ppm.

* * * * *